US007152268B2

(12) United States Patent
Phillips, III et al.

(10) Patent No.: US 7,152,268 B2
(45) Date of Patent: Dec. 26, 2006

(54) BRUSH ASSEMBLY

(75) Inventors: Daniel Cunnington Phillips, III, Bel Air, MD (US); Yury Polikov, Pikesville, MD (US); Joseph John Weishew, Oreland, PA (US)

(73) Assignee: Sun Automation, Inc., Sparks, MD (US)

( * ) Notice: Subject to any disclaimer, the term of this patent is extended or adjusted under 35 U.S.C. 154(b) by 0 days.

(21) Appl. No.: 11/431,221

(22) Filed: May 11, 2006

(65) Prior Publication Data

US 2006/0230565 A1 Oct. 19, 2006

Related U.S. Application Data

(62) Division of application No. 11/004,718, filed on Dec. 6, 2004, now Pat. No. 7,096,529.

(51) Int. Cl.
*A46B 13/00* (2006.01)

(52) U.S. Cl. ..... 15/179; 15/182

(58) Field of Classification Search ..... None
See application file for complete search history.

(56) References Cited

U.S. PATENT DOCUMENTS

| | | | | |
|---|---|---|---|---|
| 2,821,729 | A * | 2/1958 | Clief, Jr. | 15/181 |
| 3,329,986 | A * | 7/1967 | Hackworth | 15/179 |
| 4,267,616 | A * | 5/1981 | Hunt | 15/182 |
| 5,659,853 | A * | 8/1997 | Matsuda et al. | 399/176 |

* cited by examiner

*Primary Examiner*—David Redding
(74) *Attorney, Agent, or Firm*—William E. Mouzavires

(57) ABSTRACT

A corrugated box finishing machine has a station where dust, debris and other particles are cleaned from the corrugated boards before they are conveyed to the printing station. Electrostatic charges on the particles are neutralized by a static bar and the particles are then removed from the boards by a rotating brush. The particles are drawn into a vacuum chamber underlying the path of conveyance of the boards, and the static bar is positioned in an enclosure in proximity to the boards but isolated from the vacuum in the vacuum chamber. The enclosure has surfaces which direct the particles away from the static bar which is oriented to further minimize contact with the removed particles. The cleaning brush includes a plurality of brush sections mounted on a rotatable shaft made from carbon fiber material.

11 Claims, 9 Drawing Sheets

BRUSH ASSEMBLY

The present invention is a divisional of our U.S. patent application Ser. No. 11/004,718 entitled BOX FINISHING MACHINE WITH CLEANING APPARATUS AND METHOD, filed Dec. 6, 2004, now U.S. Pat. No. 7,096,529.

OBJECTS OF THE PRESENT INVENTION

The present invention generally relates to box finishing machines for printing, slotting and creasing corrugated boards to be formed into boxes. More specifically the present invention relates to a box finishing machine that is improved with apparatus which cleans dirt, debris, and other particles and substances from the corrugated boards as they are transported to the printing station. Also included is a novel method of cleaning corrugated boards while being processed in a box finishing machine.

A primary object of the present invention is to provide a box finishing machine that includes a novel apparatus for cleaning dust, debris and other particles and substances from the boards as they are transported through the machine. Included herein is such apparatus that may be incorporated in new or retrofitted in old or existing machines without any substantial rearrangement of the basic parts of the machine such as the printing and die cutter apparatus.

A further object of the present invention is to provide a novel method and an improved system for cleaning dust, debris and other substances from corrugated boards during their processing in a box finishing machine. Included herein is such a system which utilizes a vacuum for holding the boards flat during cleaning and for drawing the substances removed from the boards to a collection chamber for easy disposal.

A still further object of the present invention is to provide a novel and improved cleaning method and system for cleaning flat objects such as corrugated boards and which utilizes a novel brush assembly for wiping the objects without damaging or marring the surface of the objects.

Another object of the present invention is to provide a novel and improved rotatable cleaning brush assembly which is lighter and operates with less vibration than conventional brush assemblies. Included herein is such a cleaning brush assembly whose brushes may be easily replaced or repositioned when worn to increase the life of the brush assembly. Also included herein is a brush assembly having a novel and improved construction.

SUMMARY OF THE PREFERRED EMBODIMENT OF THE PRESENT INVENTION

In its preferred form, the present invention includes cleaning apparatus at a station located prior to the printing station in a corrugated box finishing machine for removing particles from the corrugated boards on their way to the printing station. The apparatus includes a vacuum chamber underlying the path of conveyance of the boards for holding the boards flat for conveyance by transfer rolls. The vacuum chamber also receives the particles after they are removed from the boards by a rotating brush and directs the particles to a collection chamber. The particles have an electrostatic charge which adheres the particles to the boards. To neutralize the charge and facilitate removal of the particles by the rotating brush, a static bar is mounted in a holder, preferably an enclosure, located in the vacuum chamber in proximity to the boards. The enclosure isolates the static bar from board jams while also preventing its emitted ions from being drawn or misdirected by the vacuum away from the surface of the corrugated boards. The enclosure has an open end situated adjacent the boards through which the ions pass to reach the boards. The surfaces around the open end are inclined to direct dust and other particles from collecting on the static bar. The latter is oriented to minimize contact with the dust and particles removed from the boards.

The cleaning brush has a novel construction including a plurality of cylindrical sections mounted along an elongated tubular shaft, made of a carbon fiber composite material. The brush bristles are made of anti-static nylon material held by a core wound about and bonded to an aluminum tube. Journals for rotating the shaft are bonded in the opposite ends of the shaft. Mounted on and fixed to the opposite ends of the journals are retaining collars which hold the brush sections in position on the brush shaft. The brush sections can be replaced or repositioned by removing the retaining collars on the ends of the shaft.

DRAWINGS

Other objects and advantages of the present invention will become apparent from the following detailed description taken in conjunction with the attached drawings in which.

DETAILED DESCRIPTION

Figure 1:
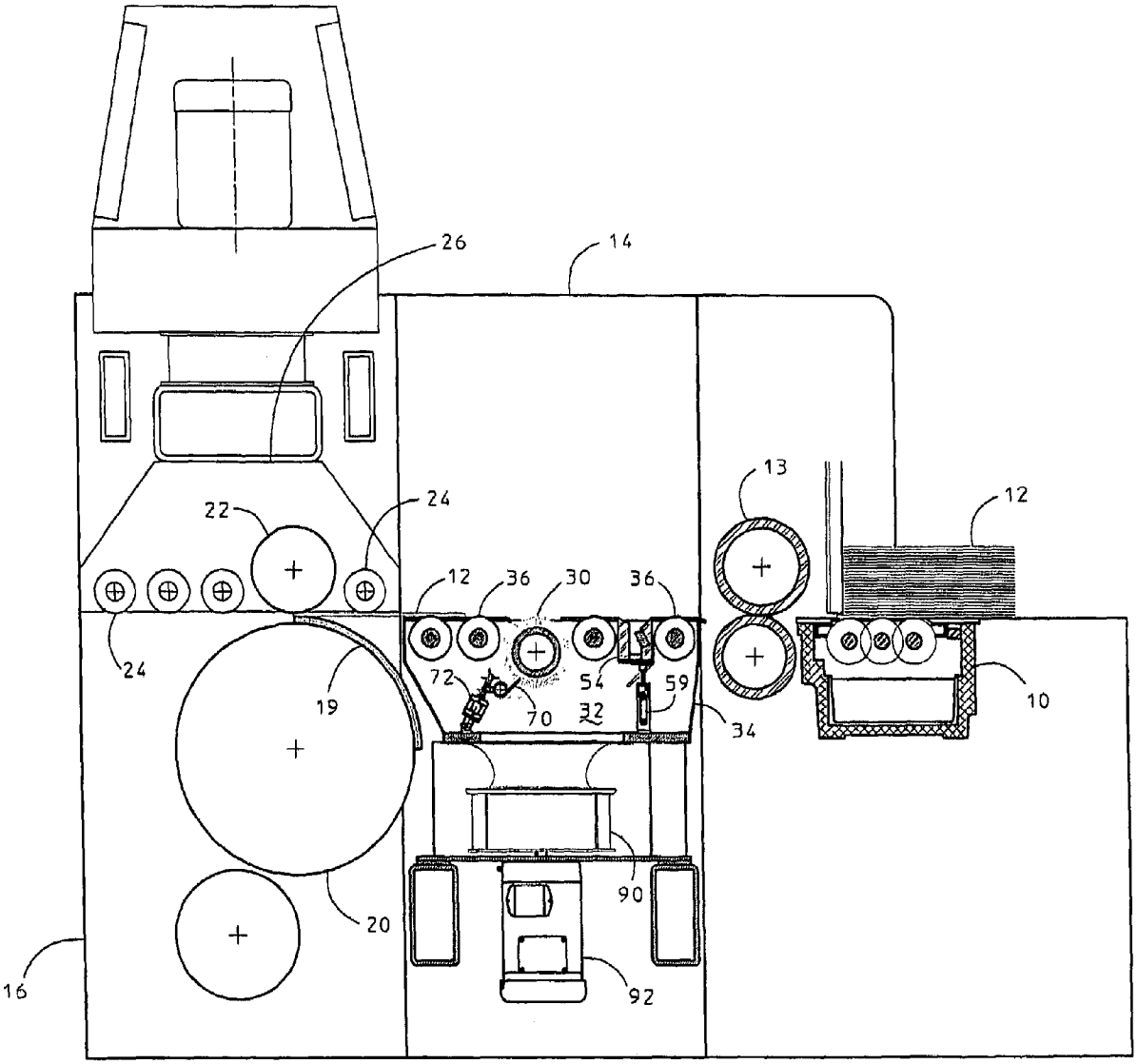
FIG. 1 is a side elevational view of a box finishing machine embodying the present invention in its preferred form but with certain parts removed.

Referring now to FIG. 1 of the drawings, there is shown a corrugated box finishing machine constituting a preferred embodiment of the present invention. The machine includes a feeder generally designated 10 for feeding corrugated boards 12 along a horizontal path through feed rolls 13 to a cleaning station 14 embodying the present invention, after which the boards are fed to one or more printing stations 16 where they are printed with desired indicia. The boards are then fed to a die cutter station (not shown) where slots and/or creases are formed in the boards by a rotary die cutter. The boards are then fed by pull rolls to a stacking and strapping station (not shown).

A more detailed description of a preferred feeder 10 can be found in U.S. Pat. No. 5,184,811 issued Feb. 9, 1993 assigned to the assignee of the present application. The disclosure of this U.S. Pat. No. 5,184,811 is hereby incorporated into the present application by reference as part hereof. It will be understood however that other feeders may be used in carrying out the present invention.

A more detailed description of the printing station 16 which includes a print cylinder 20, printing dies 19 mounted on the surface of the print cylinder, an impression cylinder 22 and rotating vacuum transfer rolls 24 may be found in U.S. Pat. No. 6,179,763 issued Jan. 30, 2001 which is assigned to the assignee of the present invention and is also hereby incorporated by reference into the subject application as part hereof. A vacuum produced in overhead chamber 26 holds the boards against rotating transfer rolls 24 which move the boards along the path towards the die cutter station. It will be understood that any other suitable printing station may be employed without departing from the present invention.

Although the rotary die cutter which is downstream of the printing station 16 is not shown, a more detailed description of it can be found in U.S. Pat. No. 6,609,997 issued Aug. 26, 2003 and assigned to the assignee of the subject patent application and hereby incorporated into the subject patent application as part hereof. Here again it will be apparent that any other suitable rotary die cutter may be employed without departing from the present invention.

Figure 2:
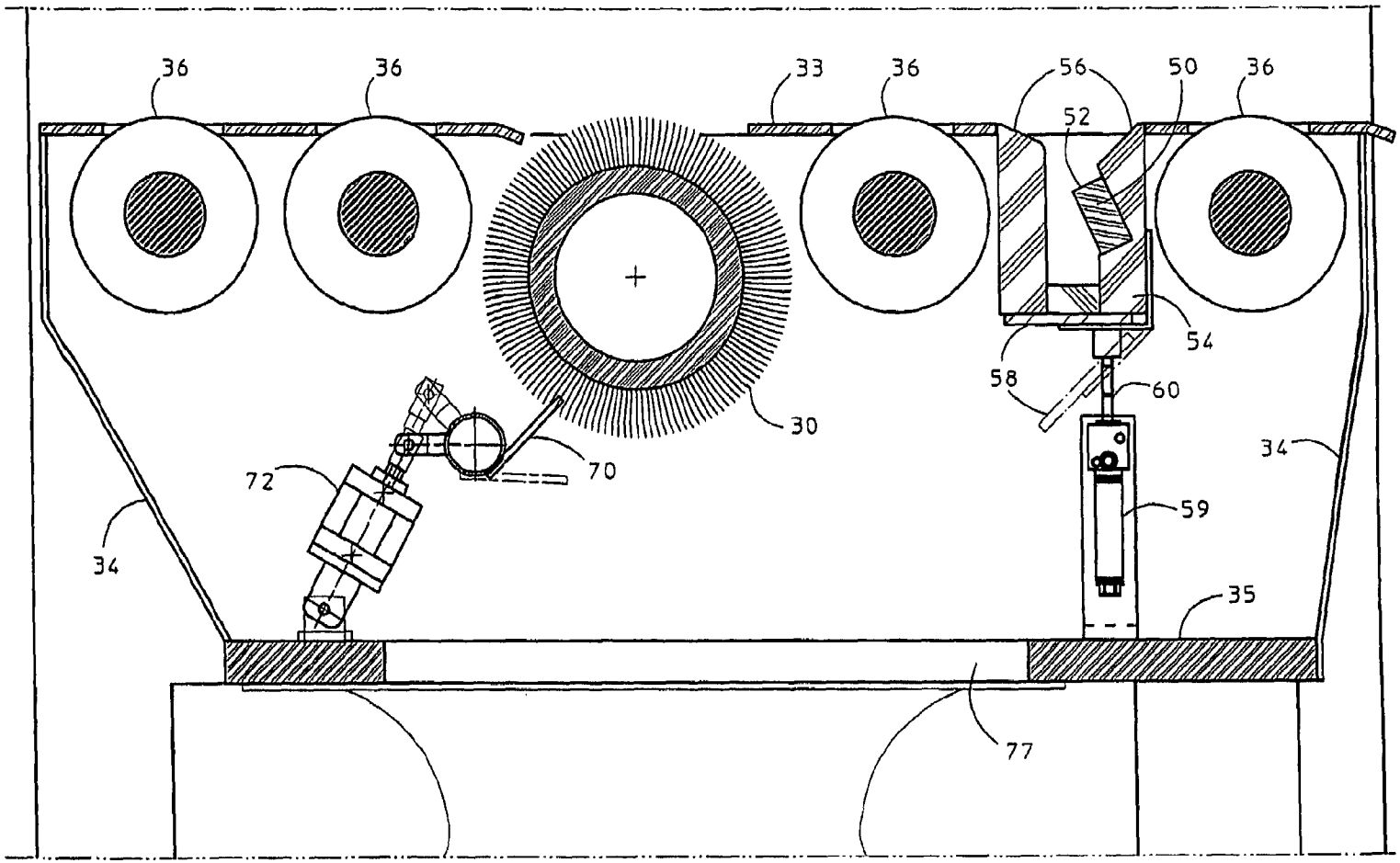
FIG. 2 is an enlarged side view in cross section of cleaning apparatus included in FIG. 1.
Figure 3:
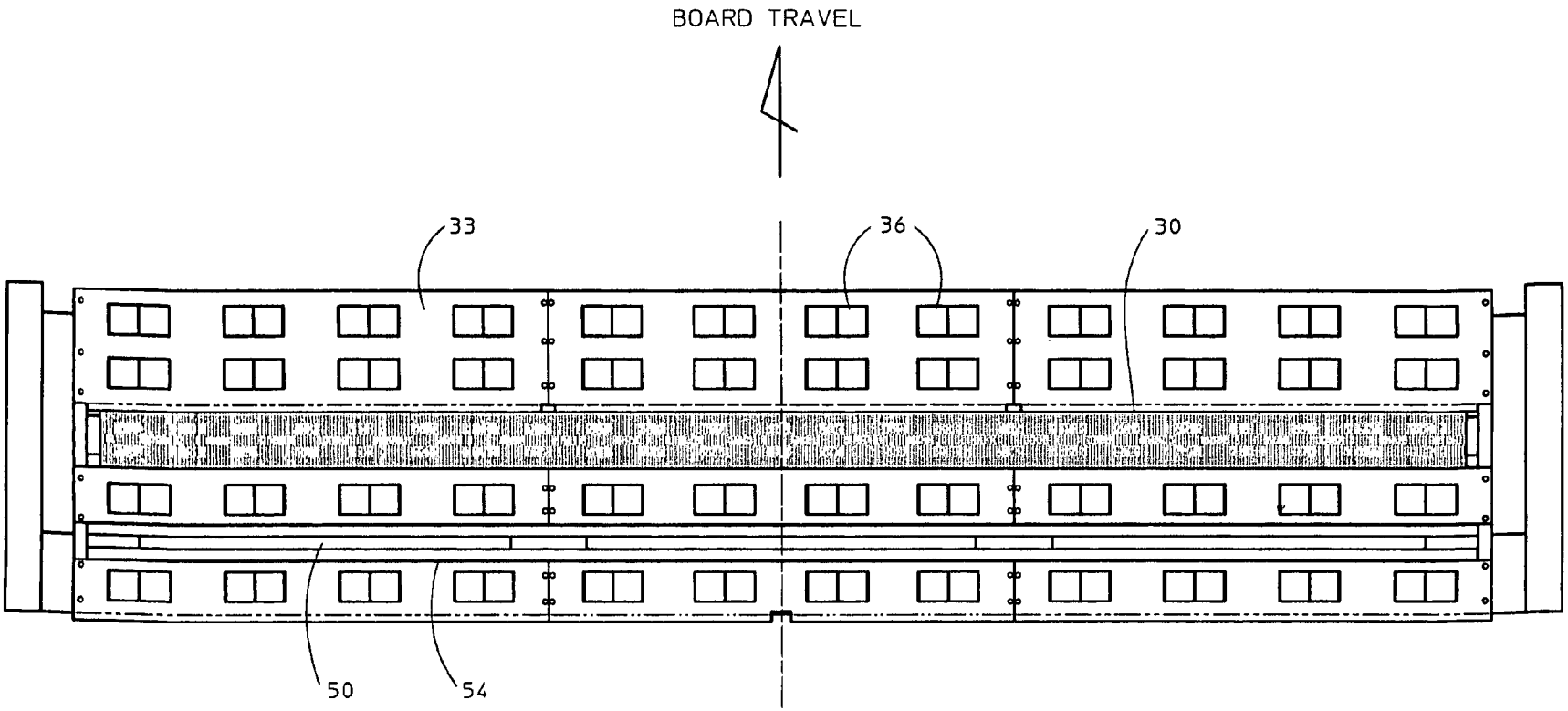
FIG. 3 is a top view of the apparatus of FIG. 2.

Returning now to the cleaning station 14, apparatus is provided there to remove dust, debris, pieces of paperboard, and other particles and substances from the boards 12 before they are conveyed to the printing and die cutter stations. Such extraneous matter can adversely produce irregularities in the printed image on the boards by accumulating on the dies of the printing station. The cleaning apparatus of the present invention includes a rotating cleaning brush 30 mounted for rotation in a vacuum chamber 32 formed by side walls 34 and bottom wall 35 below the path of travel in the specific embodiment shown. As shown in FIGS. 1 and 3 the brush extends below and transversely of the path of travel of the boards. In one specific embodiment the overall length of the brush is approximately 113 inches including its end journals. Vacuum chamber 32 has a slotted upper wall 33 to accommodate a plurality of transport rolls 36 as shown in FIGS. 2 and 3. The latter are mounted for rotation in the vacuum chamber 32 to engage the underside of the boards 12 and transport them along the path through the cleaning station 14 and to the printing station 16. Transport rolls 36 are driven in any suitable manner and are made from a suitable friction material such as a polyurethane to engage the undersurface of the boards 12 and drive them to the printing station 16 while the vacuum in chamber 32 holds the boards 12 flat on the transport rolls 36. The surface speed of the transport rolls 36 is set to match the speed of the feed rolls 13 and the transport rolls 24 and print and impression cylinders 20 and 22 at the print station 16 so that registered feeding of the boards is maintained from the feeder 10 and feed rolls 13 to and through the print station 16. The use of the transport rolls 36 and vacuum chamber 32 eliminates the need to drive the boards 12 into the nip of the print and impression cylinders 20 and 22 by means of feed rolls 13 which at times may cause the boards 12 to lose register due to slippage or other effects of the feed rolls 13.

In the specific embodiment shown, a rotating cleaning brush 30 is located between two transport rolls 36 to engage the underside of the boards and remove dust, debris, pieces of paperboard and other particles and substances from the boards as they pass over the brush 30. Any suitable drive system (not shown) may be used to rotate the brush 30, and it may be connected to the drive of the feeder 10. As will be described below, brush 30 has a novel construction which is lighter and stiffer than conventional brushes and therefore reduces vibration which not only allows the brush speed to be increased, it also allows the brush to lightly wipe the boards clean without damaging, marring or marking the surface of the boards.

To facilitate removal of the particles from the boards by the brush 30, which particles are often electro-statically charged and adhere to the boards, a static bar 50 is mounted along the path of board-travel to direct ions to the underside of the boards to neutralize the charge on the particles on the boards. Any suitable static bar may be used such as the R50 Blue Bar made by Simco Industrial Static Control. However provision is made for minimizing, if not avoiding contact of the ion-emitting surface 52 of the static bar 50 with the dust, debris and other extraneous matter in the area. To this end, in the preferred embodiment, the static bar 50 is mounted in a holder 54 located in the vacuum chamber 32 with the static bar surface 52 adjacent to the path of travel so as to direct ions to the underside of the boards 12 to neutralize the particles to be removed therefrom. In the preferred embodiment the holder is an enclosure made from any suitable nonconductive material, and the static bar 50 is located in a recess in the vertical wall of the holder so that the ion-emitting surface 52 extends at an angle to the horizontal path of travel. Moreover the surfaces 56 of the holder at the top opening of the holder are inclined downwardly to direct falling dust, debris and other particles away from the ion-emitting surface 52 of the static bar. In this way the ion-emitting surface 52 is kept free of extraneous foreign matter which would otherwise require periodic stoppage of production in order to clean the matter from the static bar. In the preferred embodiment shown the foreign matter collected in the enclosure 54 is removed from an opening in its bottom which is normally closed by a closure 58. The latter is activated to open and closed position by any suitable actuator shown at 59 having a rod 60 pivotally connected to the closure 58. Since in the preferred embodiment, the static bar 50 is located in the vacuum chamber 32, the enclosure 54 also serves to isolate the bar 50 from the vacuum in the chamber 32 which could otherwise cause the ions to be misdirected away from the undersurface of the boards 12. The positioning of the static bar also serves to isolate it from any machine or board jams that may occur during production.

Figure 4:
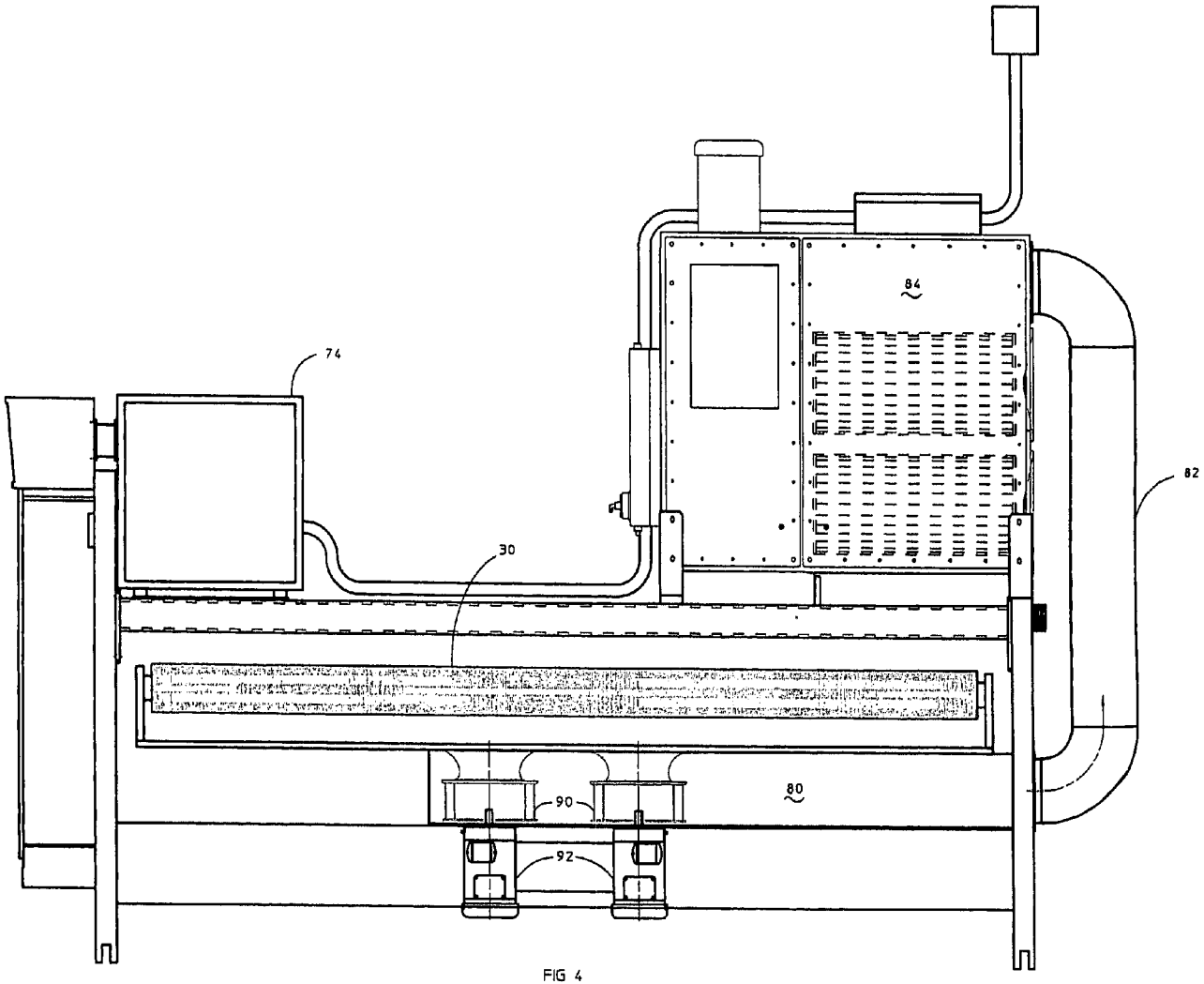
FIG. 4 is a front view of the apparatus of FIG. 2.

The rotating brush 30 has anti-static nylon bristles periodically cleaned by a plurality of suitable beater blades 70 which are actuated by any suitable motor shown at 72. Actuators 59 and 72 may be energized automatically at predetermined intervals through a programmable controller or any other suitable control 74 (FIG. 4) to remove collected particles from the enclosure 54 and brush 30. During operation of the machine, the particles are constantly drawn downwardly by the vacuum in the chamber 32 and through an opening 77 in the bottom wall 35, shown in FIG. 2. As shown in FIG. 4 the particles then move through an exhaust duct 80 below the brush to one side and then vertically through a duct 82 and collected in a dust collecting unit 84. The vacuum in the chamber is generated in the preferred embodiment shown by two blowers 90 located in exhaust duct 80 and driven by motors 92 as shown in FIG. 4.

To summarize operation of the cleaning apparatus, when the boards 12 pass over the enclosure 54 the static bar 50 will send ions to the board to neutralize the charges of any extraneous particles or matter on the surfaces of the boards. Any such matter falling into the enclosure 54 will be largely diverted from the surface 52 of the static bar 50 and drop to the bottom of the enclosure. The boards will be transported by rolls 36 to and over the rotating brush 30 which will wipe the particles from the boards with ease since the particles will have been neutralized by the static bar 50 and no longer cling to the boards through electrostatic forces. The particles removed from the boards will be drawn away by vacuum to the collector 84. When the boards 12 reach the printing station 16, the lower surfaces will have been cleaned of extraneous matter to enable the desired images to be printed in precise and complete fashion on the surfaces. The printing dies will no longer accumulate the extraneous matter which otherwise would impair the printing by the dies and require stoppage of production in order to clean the dies.

Another feature of the present invention resides in the interpositioning of the cleaning station 14 between the feed rolls 13 and the print and impression cylinders 20 and 22 which allows the boards 12 to be freely fed to the latter after they have left the nip of feed rolls 13. This avoids the adverse affects which can result at times from feeding the boards to the print and impression cylinders 20, 22 directly from the feed rolls 13 during which the boards are initially held at their opposite ends in the nips of the print and impression cylinders as well as the feed rolls. At times this can cause the boards to lose their register with the print and impression cylinders which in turn can impair the printing on the boards and other operations downstream of the print station.

Figure 6:
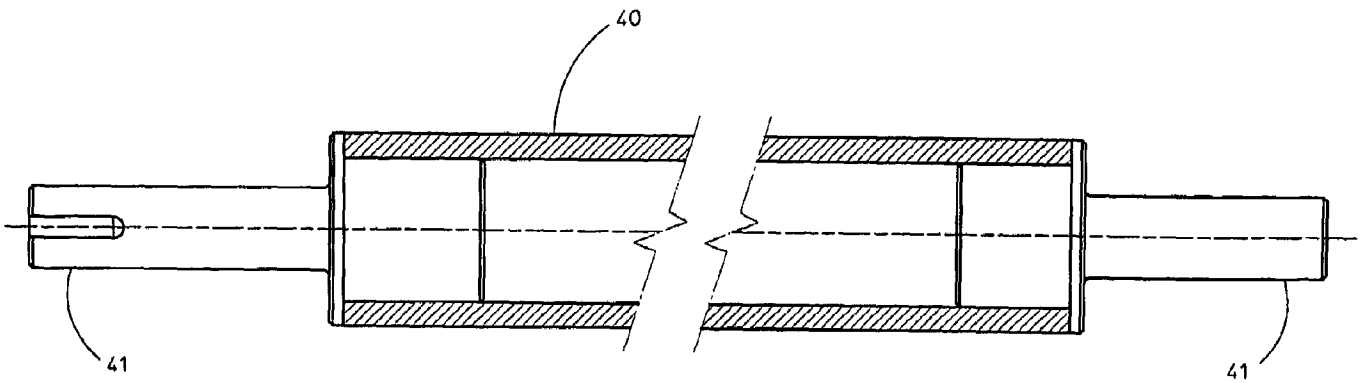
FIG. 6 is an enlarged fragmental view of the shaft of the brush of FIG. 5 including journals in the opposite ends thereof but excluding other parts.
Figure 7:
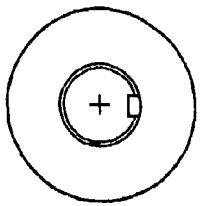
FIG. 7 is an end view of the shaft of FIG. 6.

In accordance with another invention feature, the cleaning brush 30 is made with a novel and improved construction including an elongated shaft 40 made from a carbon fiber and resin composite material, for example that made in industry under the trade designation, heavy duty 33 modulus NIM-COR. In one preferred embodiment the shaft 40 weighs approximately thirty-five (35) pounds and is approximately one hundred and three and one half (103½) inches and has a diameter of approximately three and one half (3½) inches. The shaft 40 is rotatable by any suitable drive means up to a maximum speed of 683 rpm. and to that end steel journals 41 are bonded to the shaft 40 in the opposite ends thereof as shown in FIG. 6. In one specific embodiment the journals have a length of about five and three eights (5⅜) inches. The shaft is stiffer and about one fifth the weight of conventional steel shafts and therefore its deflection is about one half that of conventional steel shafts. In addition the composite shaft is well suited to elongated shafts and does not require any center support between its journals. Moreover it substantially reduces vibration and is able to rotate at higher speeds without resonating with the result that the brush is able to lightly wipe the board clean efficiently and without damaging or marring the surface of the boards.

Figure 5:
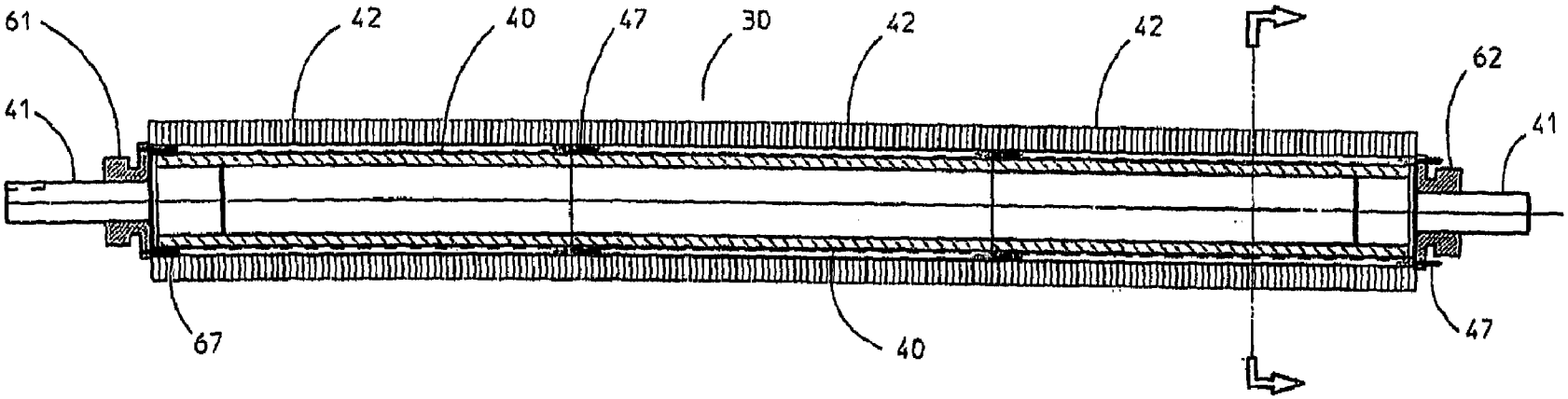
FIG. 5 is a longitudinal cross-sectional view of a cleaning brush incorporated in the cleaning apparatus.
Figure 8:
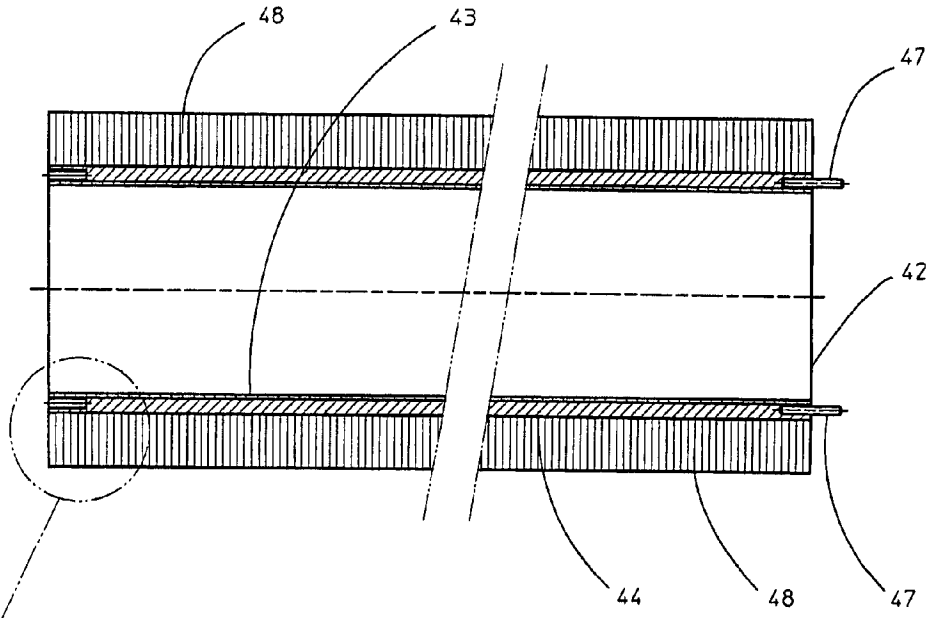
FIG. 8 is a fragmental cross-sectional view of a section of the brush.
Figure 10:
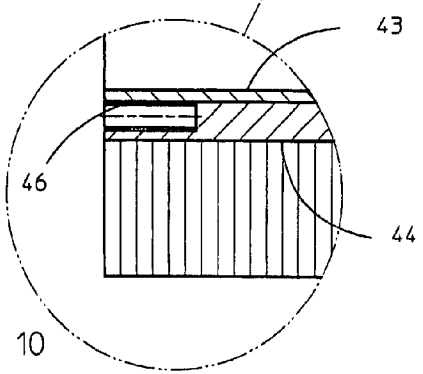
FIG. 10 is an enlarged fragmental view of the lower left hand section of FIG. 8.
Figure 9:
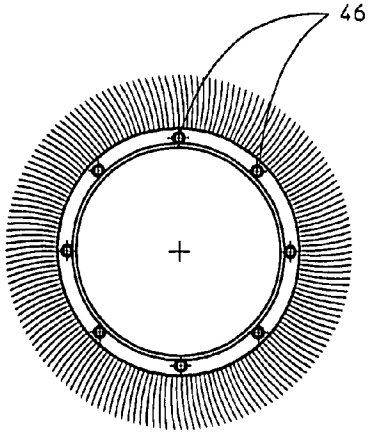
FIG. 9 is an end view of the brush of FIG. 8.

Brush 30 includes a plurality of tubular bristle sections 42 mounted on and along shaft 40 in abutting relationships as best shown in FIG. 5. In the preferred embodiment of the present invention four brush sections 42 are employed however it will be understood that the number depends on the length of the shaft 40. Referring to FIGS. 8–10, brush sections 42 are generally cylindrical and include an inner tube 43 preferably made of aluminum and having a length of twenty-six (26) inches and a diameter of about three and one half (3½) inches to fit around the brush shaft 40. Wound around the inner tube 43 is a cylindrical core 44 formed of fibrous cotton, rope-like material and epoxy, the latter also serving to bond the material to the tube 43. The brush bristles 48 are wound in the core 44. In the preferred embodiment the bristles are anti-static nylon 0.010 inches in diameter while the core 44 is provided by the commercial product designated as FINESET 3R54.

Figure 12:
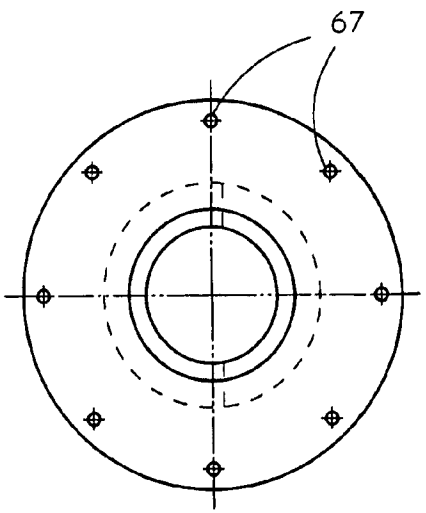
FIG. 12 is a right hand end view of the collar of FIG. 11.
Figure 11:
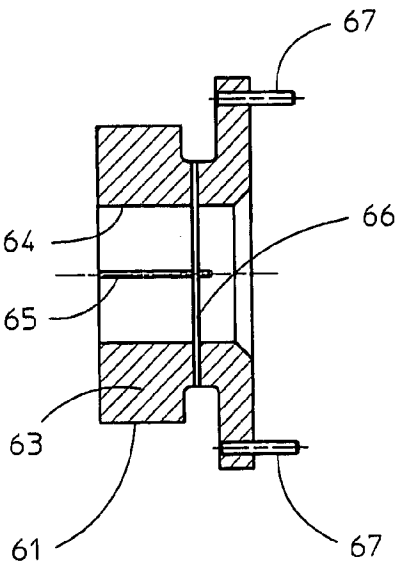
FIG. 11 is a cross-sectional view of a retaining collar which mounts on one end of the brush shaft to retain the brush sections on the shaft.
Figure 13:
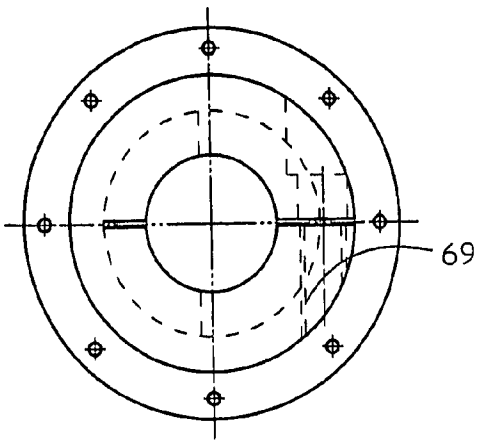
FIG. 13 is a left hand end view of the collar of FIG. 11.
Figure 14:
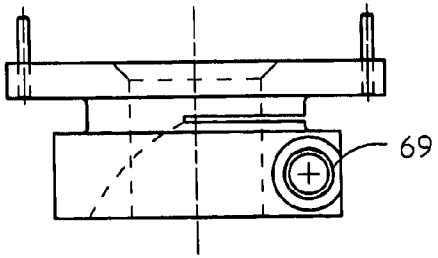
FIG. 14 is a top view of the collar.
Figure 16:
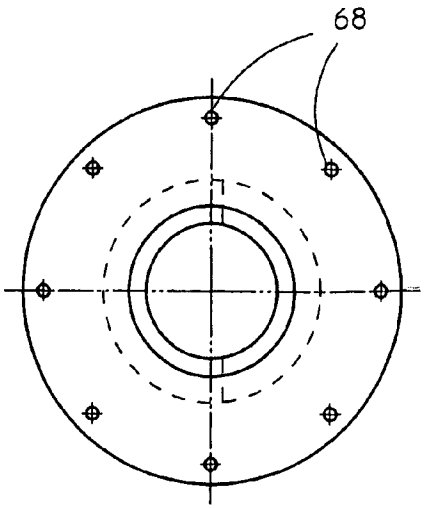
FIGS. 15 through 18 are views corresponding to FIGS. 11 through 14 of a retaining collar mounted on the other end of the brush shaft.
Figure 15:
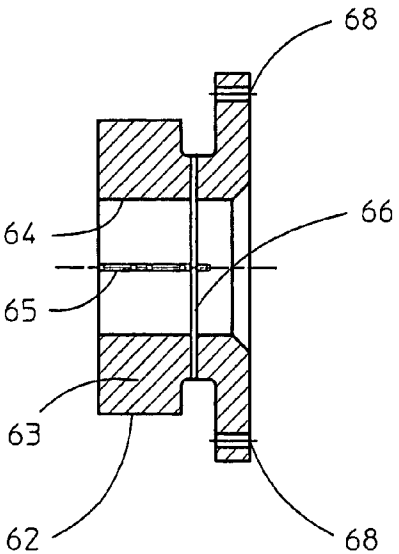
Figure 17:
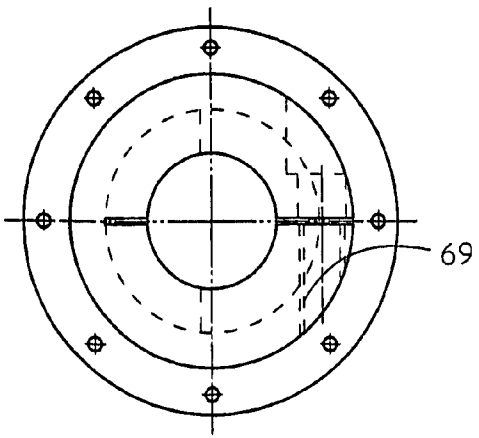
Figure 18:
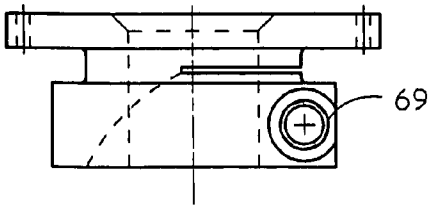

After the brush sections 42 are assembled on the shaft 40 with the use of the pins 47 as described above, they are held in position by a pair of retaining members shown as collars 61 and 62 fixed on the end journals as shown in FIG. 5. Referring to FIGS. 11 and 15, collars 61 and 62 have central through passages 64 which receive the journals to which they are fixed by clamps formed by bifurcated sections 63 of the collars, the latter being partly defined by longitudinal and circumferential slits 65 and 66 formed in portions 63 of the collars 61 and 62. Collars 61 and 62 are positioned with respect to the journals 41 and the end most brush sections 42 by pins 67 and 47. In the shown embodiment, pins 67 are fixed at equi-angularly spaced locations on the male retaining collar 61 as shown in FIGS. 11 and 12 for receipt in eight corresponding slots formed by the micro sleeves 46 in the end of the adjacent brush section, see FIGS. 5, 9 and 10. As shown in FIG. 15, the other retaining collar 62, which may be termed a female collar, is provided with eight apertures 68 for receiving the pins 47 projecting from the end of the adjacent most brush section as best shown in FIG. 5 to position the female collar 62 against the adjacent journal 41 and brush section. Once positioned, the retaining collars 61 and 62 are fixed to the journals 41 by the bifurcated clamp portions of the collars. This is effected by screw bolts advanced in threaded passages 69 formed in the bifurcated portions of the retaining collars as best shown in FIGS. 13, 14 and 17 and 18.

As best shown in FIG. 5 the brush sections 42 are interconnected and abut each other on the shaft 40, and this is accomplished in the preferred embodiment by pins 47 projecting from one end of each brush section 42 and passages formed by micro sleeves 46 in the opposite end of each brush section 42 as shown in FIGS. 8 and 10. The pins 47 of one brush section are received in the micro sleeves 46 of the adjacent brush section to secure the sections together. In the specific embodiment shown, eight (8) pins 47 and micro sleeves 46 are used at equiangularly spaced positions in the ends of the cores 44 of the brush sections, see FIGS. 8, 9 and 10. In operation, should the brush bristles become worn on one or more brush sections 42, the latter may be easily repositioned along the brush shaft 40 or replaced by removing one or both retaining collars 61 and 62 to access the brush sections 42 for repositioning or replacement during which the brush sections are easily slid along the shaft 40. It will be seen that the brush assembly is not only lighter and stiffer than conventional cleaning brushes, while being easily replaced or repositioned to extend the life of the brush assembly, the brush is also rotatable at higher speeds without resonating due to its light weight and stiffness resulting in more efficient but light wiping contact with the boards without marring the surface of the boards.

Although specific preferred embodiments of the present inventions have been shown and described above, it will be appreciated that variations of the inventions will become apparent to those skilled in the art but without departing from the scope of the inventions which is defined in the appended claims.

What is claimed is:

1. A brush assembly for cleaning objects including an elongated lightweight hollow shaft made from synthetic fiber material, a pair of journals fixed in opposite ends of said shaft respectively, a plurality of abutting cylindrical brush sections mounted on and along said shaft and having ends with means interconnecting said sections, a pair of collars fixed on said journals and abutting end brush sections to secure the brush sections in position along said shaft.

2. The brush assembly defined in claim 1 wherein said shaft is made from a carbon fiber and resin material.

3. The brush assembly defined in claim 1 wherein said means on the ends of said brush sections includes pins and slots receiving said pins.

4. The brush assembly defined in claim 3 wherein one of said collars has pins received in slots in the adjacent brush section.

5. The brush assembly defined in claim 4 wherein said collars have bifurcated portions secured about said journals respectively.

6. The brush assembly defined in claim 5 wherein said shaft is made from carbon fiber material.

7. The brush assembly defined in claim 1 wherein said collars have bifurcated portions secured about said journals respectively.

8. The brush assembly defined in claim 6 wherein said journals are made from a lightweight metallic material.

9. The brush assembly defined in claim 1 wherein said journals are made from a lightweight metallic material.

10. The brush assembly defined in claim 2 wherein said journals are made from aluminum.

11. The brush assembly defined in claim 1 wherein said shaft is stiffer and about one fifth lighter than conventional steel shafts of the same size.

* * * * *